US006719338B2

(12) United States Patent
Shen

(10) Patent No.: US 6,719,338 B2
(45) Date of Patent: Apr. 13, 2004

(54) DUMMY TRIM WITH AN IMPROVED RESISTANCE TO PULL

(76) Inventor: Mu-Lin Shen, No. 32, Lane 76, Fu-An Road, Sec. 5, Tainan (TW)

( * ) Notice: Subject to any disclaimer, the term of this patent is extended or adjusted under 35 U.S.C. 154(b) by 0 days.

(21) Appl. No.: 10/073,648

(22) Filed: Feb. 11, 2002

(65) Prior Publication Data

US 2003/0151264 A1 Aug. 14, 2003

(51) Int. Cl.[7] ..... E05B 15/02

(52) U.S. Cl. ..... 292/357; 16/412; 292/348; 292/353; 292/DIG. 53; 292/DIG. 63; 70/224; 70/451

(58) Field of Search ..... 16/412; 292/1, 292/336.3, 347, 348, 349, 352, 353, 355, 357, DIG. 53, DIG. 63, 354; 70/224, 451, 452, 466

(56) References Cited

U.S. PATENT DOCUMENTS

| | | | | | |
|---|---|---|---|---|---|
| 2,156,486 | A | * | 5/1939 | Wertz | 292/354 |
| 2,210,797 | A | * | 8/1940 | Crim | 292/354 |
| 2,739,006 | A | * | 3/1956 | Fisler | 292/352 |
| 2,801,123 | A | * | 7/1957 | Kubik et al. | 292/352 |
| 2,827,323 | A | * | 3/1958 | Kessel et al. | 292/352 |
| 2,842,389 | A | * | 7/1958 | Muttart et al. | 292/352 |
| 3,091,490 | A | * | 5/1963 | Williams | 292/352 |
| 3,580,619 | A | * | 5/1971 | Maltais | 403/365 |
| 4,502,719 | A | * | 3/1985 | Perry | 292/347 |
| 4,639,026 | A | * | 1/1987 | Smallegan | 292/169.23 |
| 4,679,420 | A | * | 7/1987 | Yang | 292/348 |
| 4,995,249 | A | * | 2/1991 | Preissler et al. | 70/224 |
| 5,190,327 | A | * | 3/1993 | Lin | 292/348 |
| 5,316,355 | A | * | 5/1994 | Hartwell et al. | 292/347 |
| 5,409,278 | A | * | 4/1995 | Harcourt | 292/348 |
| 5,688,005 | A | * | 11/1997 | Ellis | 292/348 |
| 5,749,612 | A | * | 5/1998 | Meck et al. | 292/347 |
| 5,752,399 | A | * | 5/1998 | Shen | 292/348 |
| 5,904,232 | A | * | 5/1999 | Shen | 192/69.62 |
| 5,941,108 | A | * | 8/1999 | Shen | 292/336.3 |
| 6,021,654 | A | * | 2/2000 | McCaa | 292/336.3 |

FOREIGN PATENT DOCUMENTS

| | | | | |
|---|---|---|---|---|
| EP | 0549856 A1 | * | 7/1993 | |
| GB | 2013271 A | * | 8/1979 | E05B/3/00 |
| WO | WO 88/0249 | * | 4/1988 | |

* cited by examiner

*Primary Examiner*—Robert J. Sandy
*Assistant Examiner*—Dinesh Melwani
(74) *Attorney, Agent, or Firm*—Alan Kamrath

(57) ABSTRACT

A dummy trim includes a mounting plate to be fixed to a door, a sleeve holder securely mounted to the mounting plate and including a peripheral wall, a sleeve including a first end mounted in the peripheral wall of the sleeve holder, and a lever securely attached to a second end of the sleeve to move therewith. The first end of the sleeve includes a slot having an edge facing the lever. The peripheral wall of the sleeve holder includes an integral stop extending into the slot of the sleeve and abutting against the edge of the slot.

9 Claims, 5 Drawing Sheets

DUMMY TRIM WITH AN IMPROVED RESISTANCE TO PULL

BACKGROUND OF THE INVENTION

1. Field of the Invention

The present invention relates to a dummy trim with an improved resistance to pull.

2. Description of the Related Art

FIG. 5 of the drawings illustrates a conventional dummy trim that is mounted to a door 10 for pull only. Namely, the dummy trim provides no locking function. The dummy trim comprises a sleeve holder 25 to be fixed to a door 10 such as by fasteners 26 extending Through apertures 27 formed in the sleeve holder 25, a sleeve 23 having an end held by the sleeve holder 25, a rose 22, and a lever 21 securely attached to the other end of the sleeve 23. A user may pull the lever 21 for opening the door 10. When engaging the sleeve 23 and the sleeve holder 25, both of them are drilled to farm aligned radial holes 31 and 32, and a screw or pin 30 is inserted into the radial holes 31 and 32 to thereby secure the sleeve 23 and the sleeve holder 25 together. A protective sleeve 24 may be mounted around the sleeve holder 25. However, the pulling force applied to the lever 21 exerts a shear force to the pin 30 and thus loosens the sleeve 23 after a period of time. Further, drilling of the radial holes 31 and 32 and insertion of the pin 30 are troublesome and cause an increase in the cost.

SUMMARY OF THE INVENTION

An object of the present invention is to provide dummy trim with an improved resistance to pull.

A dummy trim in accordance wit the present invention comprises a mounting plate to be fixed to a door, a sleeve holder securely mounted to the mounting plate and including a peripheral wall, a sleeve including a first end mounted in the peripheral wall of the sleeve holder, and a lever securely attached to a second end of the sleeve to move therewith. The first end of the sleeve includes a slot having an edge facing the lever. The peripheral wall of the sleeve holder includes an integral stop extending into the slot of the sleeve and abutting against the edge of the slot.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
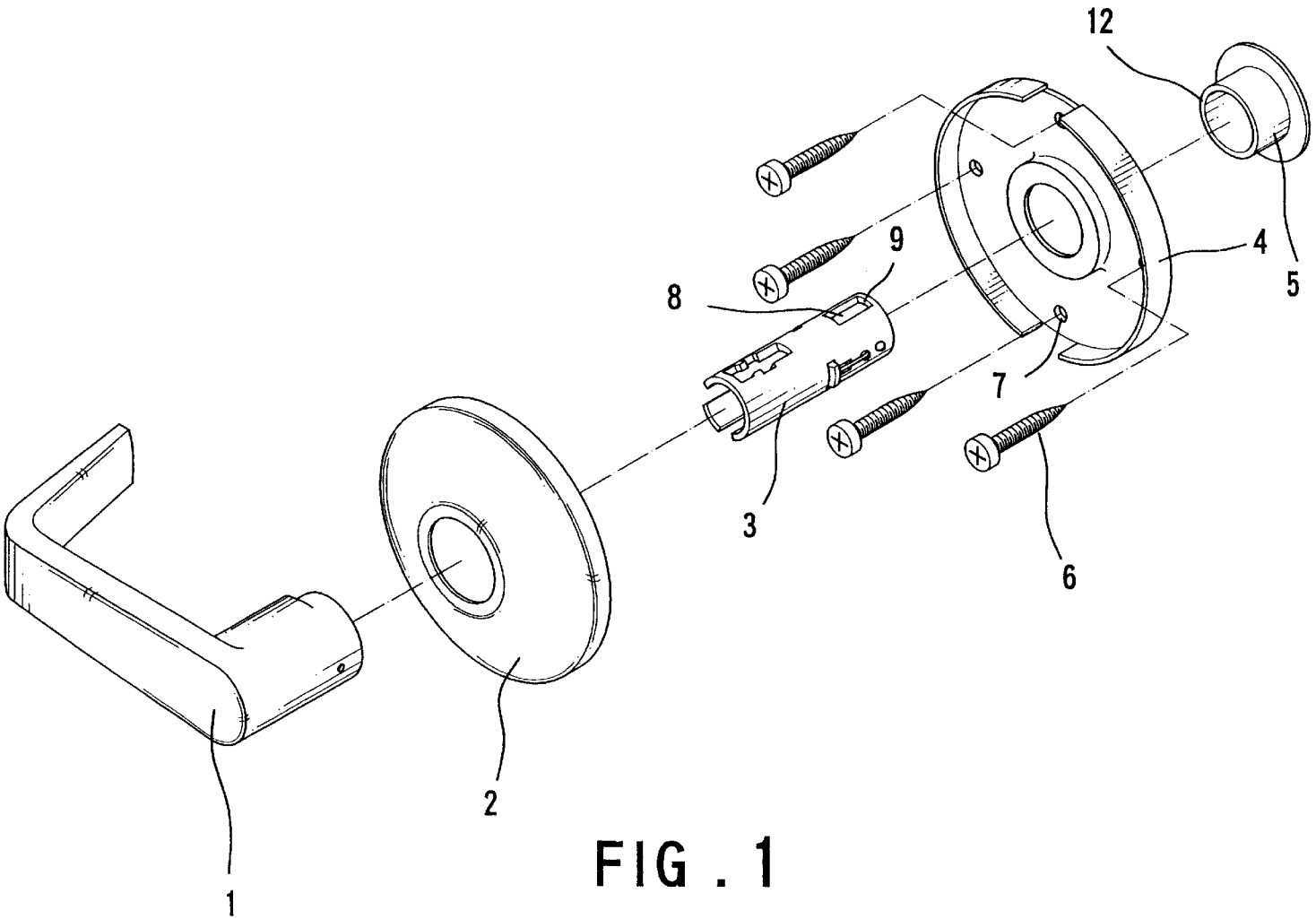
FIG. 1 is a fully exploded perspective view of a dummy trim in accordance with the present invention.
Figure 2:
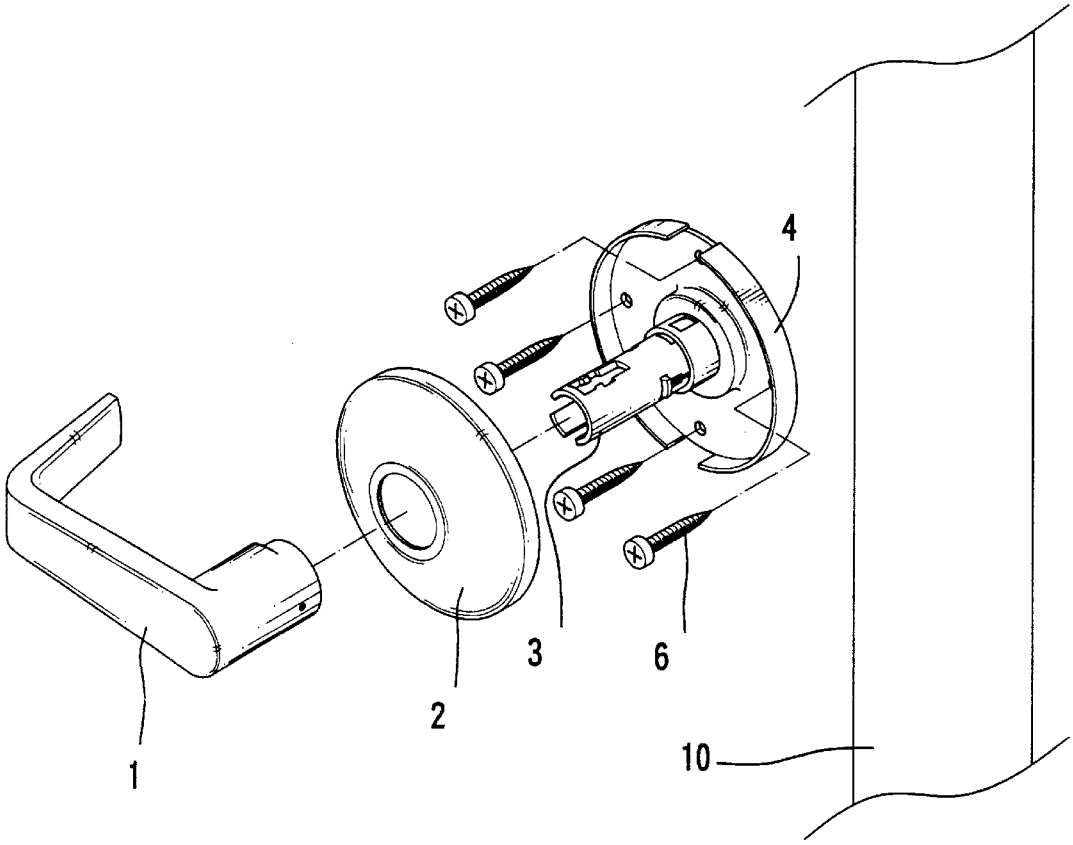
FIG. 2 is an exploded perspective view of the dummy trim in accordance with the present invention and a door to which the dummy trim is mounted.

Referring to FIGS. 1 and 2, a dummy trim in accordance with the present invention generally comprises a lever 1, a sleeve 3, a mounting plate 4, and a sleeve holder 5. The sleeve holder 5 is fixed to the mounting plate 4 and includes a peripheral wall 12. The mounting plate 4 is fixed to a door 10. Fasteners 6 are extended through holes 7 in the mounting plate 4 and into the door 10, best shown in FIG. 3.

Figure 3:
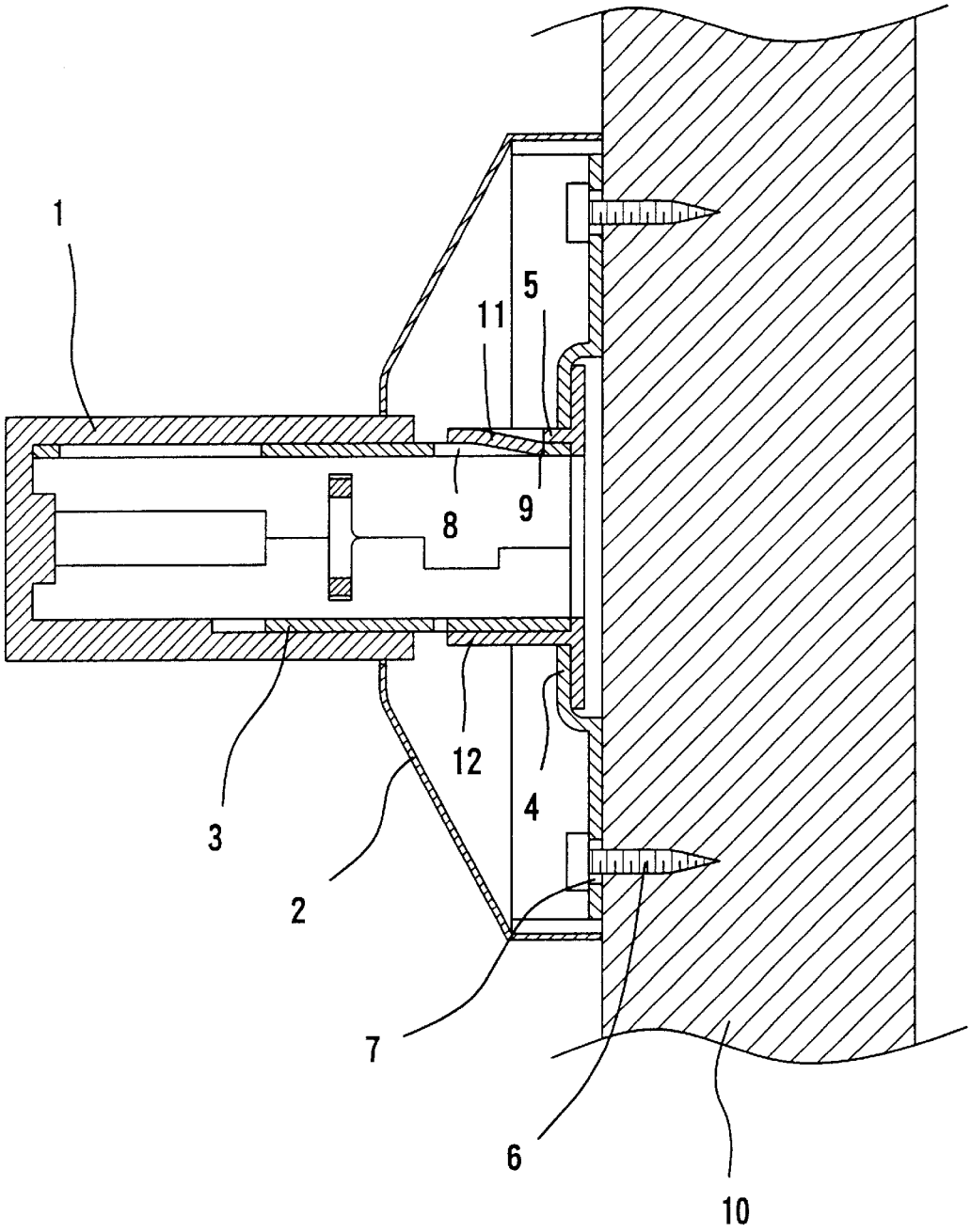
FIG. 3 is a sectional view of the dummy trim in accordance with the present invention and the door.

Referring to FIGS. 1 and 3, the sleeve 3 includes a slot 8 in an end thereof that is received in the peripheral wall 12 of the sleeve holder 5. The lever 1 is secured to the other end of the sleeve 3 to move therewith.

Figure 4:
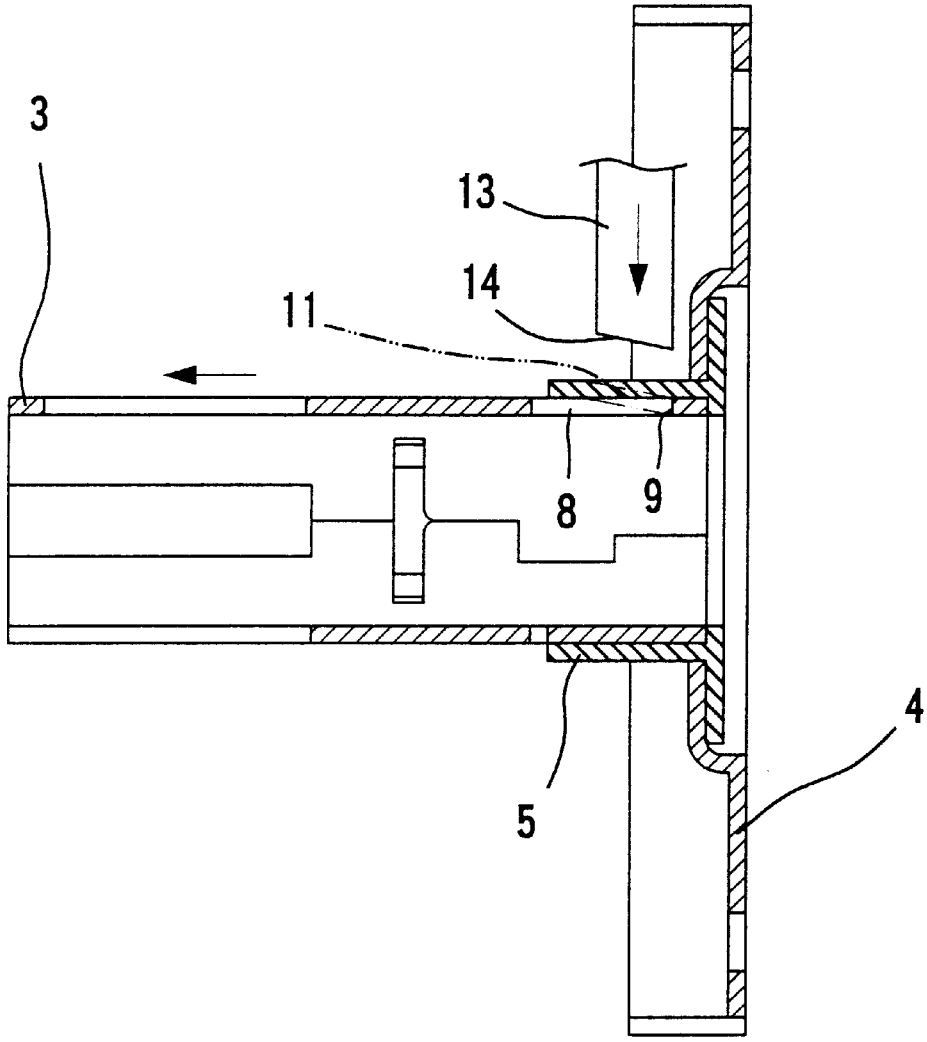
FIG. 4 is a sectional view illustrating a pressing procedure for manufacturing the dummy trim in accordance with the present invention.
Figure 5:
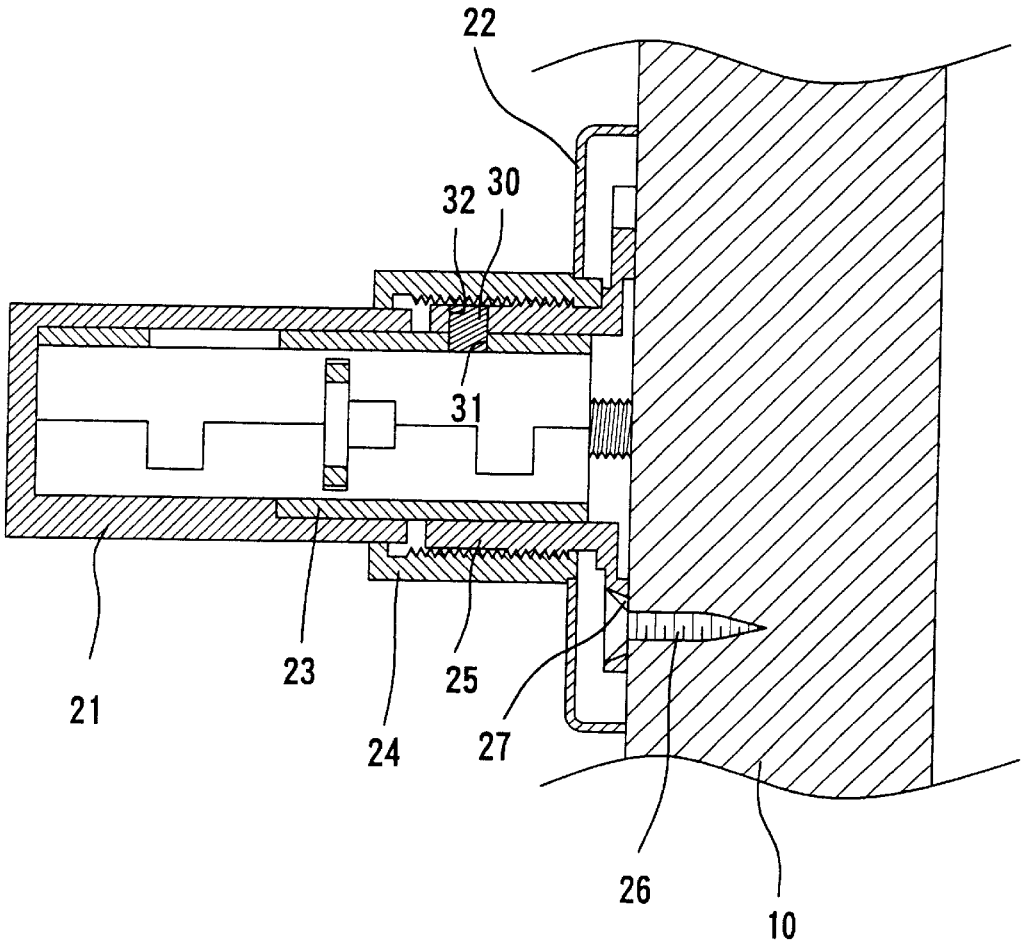
FIG. 5 PRIOR ART
FIG. 5 is a sectional view of a door and a conventional dummy trim.

Referring to FIG. 4, in manufacture, the peripheral wall 12 of the sleeve holder 5 is pressed inward by a punch member 13 in a position that aligns with the slot 8, thereby forming an inclined integral stop 11 that extends into the slot 8 of the sleeve 3 and that abuts against an edge 9 (FIG. 1) of the slot 5 that faces the lever 1. By such an arrangement, as illustrated in FIG. 3, when the lever 1 is pulled, the sleeve 3 is stopped by the integral stop 11 that is still integral with the sleeve holder 5 after the pressing procedure. The resistance to pull is increased when compared with the conventional design using a pin 30 to secure the sleeve 23 and the sleeve holder 25 together.

Preferably, the punch member 13 has an inclined bottom 14 that declines toward the mounting plate 4, as shown in FIG. 4. This avoids unnecessary deformation of the sleeve 3 and the sleeve holder 5 after pressing.

A rose 2 may be mounted to enclose the mounting plate 4, the fasteners 6, and the sleeve holder 5, thereby providing an aesthetically pleasing appearance.

Although the invention has been explained in relation to its preferred embodiment, it is to be understood that many other possible modifications and variations can be made without departing from the scope of the invention as hereinafter claimed.

What is claimed is:

1. A dummy trim comprising:

a mounting plate adapted to be fixed to a door;

a sleeve holder securely mounted to the mounting plate and including a peripheral wall;

a sleeve including a first end mounted in the peripheral wall of the sleeve holder and a second end, the first end of the sleeve including a slot, the peripheral wall of the sleeve holder extending along a longitudinal direction of the sleeve; and a lever securely attached to the second end of the sleeve to move therewith;

the slot of the sleeve having an edge facing the lever;

the peripheral wall of the sleeve holder including an integral stop extending into the slot of the sleeve and abutting against the edge of the slot, with the integral stop being punched from and remaining integral with the peripheral wall of the sleeve.

2. The dummy trim as claimed in claim 1, wherein the integral stop is formed by means of pressing the peripheral wall of the sleeve holder in a position aligning with the slot.

3. The dummy trim as claimed in claim 2, wherein the integral stop is inclined.

4. The dummy trim as claimed in claim 1, wherein the integral stop is inclined.

5. A dummy trim comprising:

a mounting plate adapted to be fixed to a door, with the mounting plate including an opening;

a sleeve holder securely mounted to the mounting plate and including a portion for abutting with the mounting plate and a peripheral wall extending from the portion and through the opening of the mounting plate;

a sleeve including a first end mounted in the peripheral wall of the sleeve holder and a second end, the first end of the sleeve including a slot, the peripheral wall of the sleeve holder extending along a longitudinal direction of the sleeve; and a lever securely attached to the second end of the sleeve to move therewith the slot of the sleeve having an edge facing the lever;

the peripheral wall of the sleeve holder on the opposite side of the mounting plate than the portion including an integral stop extending into the slot of the sleeve and abutting against the edge of the slot, with the integral stop being punched from and remaining integral with the peripheral wall of the sleeve.

6. The dummy trim as claimed in claim 5, wherein the integral stop is formed by means of pressing the peripheral wall of the sleeve holder in a position aligning with the slot.

7. The dummy trim as claimed in claim 6, wherein the integral stop is inclined.

8. The dummy trim as claimed in claim 5, wherein the integral stop is inclined.

9. A method for mounting a dummy trim to a door, comprising:

fixing a mounting plate to a side of a door;

fixing a sleeve holder to the mounting plate, the sleeve holder including a peripheral wall extending along a direction perpendicular to an extending plan of the door;

mounting an end of a sleeve in the peripheral wall of the sleeve holder, the end of the sleeve including a slot, the slot having an edge;

punching the peripheral wall of the sleeve holder in a position that aligns with the slot, thereby forming an integral stop that extends into the slot of the sleeve and that abuts against an edge of the slot; and fixing a lever to another end of the sleeve, with the integral stop stopping the sleeve when the lever is pulled to move the door.

* * * * *